US007997565B1

(12) United States Patent
Chan

(10) Patent No.: US 7,997,565 B1
(45) Date of Patent: Aug. 16, 2011

(54) COMPACT PORTABLE AIR COOLER

(76) Inventor: Kelvin Chan, Kowloon (HK)

( * ) Notice: Subject to any disclaimer, the term of this patent is extended or adjusted under 35 U.S.C. 154(b) by 895 days.

(21) Appl. No.: 11/969,637

(22) Filed: Jan. 4, 2008

(51) Int. Cl.
*B01F 3/04* (2006.01)

(52) U.S. Cl. ..... 261/99; 261/107; 261/DIG. 3

(58) Field of Classification Search ..... 261/94, 261/99, 100, 107, DIG. 3, DIG. 17, DIG. 88; 62/259.3, 406, 457.1, 457.2
See application file for complete search history.

(56) References Cited

U.S. PATENT DOCUMENTS 2,614,820 A * 10/1952 Boydjieff ..... 261/26
3,045,450 A * 7/1962 Chandler ..... 62/311
4,301,095 A * 11/1981 Mettler et al. ..... 261/30
5,046,329 A * 9/1991 Travis, III ..... 62/259.3
5,143,655 A * 9/1992 Chiu et al. ..... 261/24
5,667,732 A 9/1997 Lederer
5,802,865 A 9/1998 Strauss
6,050,551 A * 4/2000 Anderson ..... 261/30
6,149,138 A * 11/2000 Birdsell ..... 261/30
6,216,961 B1 4/2001 Utter et al.
6,374,450 B1 * 4/2002 Aoyama ..... 15/167.1
6,378,845 B1 4/2002 Hsu
6,592,107 B1 * 7/2003 Wong ..... 261/142
7,677,536 B2 * 3/2010 Wang et al. ..... 261/26
2005/0150976 A1 7/2005 Stengel
2005/0235679 A1 * 10/2005 Lee et al. ..... 62/412
2007/0257383 A1 11/2007 Chan

* cited by examiner

*Primary Examiner* — Frank Lawrence, Jr.
(74) *Attorney, Agent, or Firm* — Ronald E. Smith; Smith & Hopen, P.A.

(57) ABSTRACT

A personal air cooling apparatus includes a main housing having a hollow interior that houses a water-retaining sponge in a first chamber and a motor-driven fan in a second chamber. A partition wall separates the chambers and is apertured so that air pulled into the first chamber flows through the sponge and through the aperture into an air passageway that leads to an air outlet vent that directs a strong flow of cooled air onto the user. The first chamber has a depth less than a depth of the sponge so that an empty space is provided between the partition wall and the sponge. The empty space facilitates flow of ambient air through the sponge and reduces the load on the motor. The personal air cooling apparatus is compact and light-in-weight so that it can be carried by a user.

20 Claims, 6 Drawing Sheets

COMPACT PORTABLE AIR COOLER

BACKGROUND OF THE INVENTION

1. Field of the Invention

This invention relates, generally, to air cooling or air conditioning devices. More particularly, it relates to a portable air conditioning device that is carried by an individual.

2. Description of the Prior Art

"Swamp" or evaporative coolers are commonly used in hot, dry areas. They require a constant supply of fresh air such as from an open window. They providing a continuous output of cooled, humidified air which is a product of evaporation caused by the input air cooling as it flows through a wet air permeable wick driven by a fan. Evaporative coolers are usually large in size and require external power from a conventional household power supply. They include a reservoir with a pump component that continuously saturates the wicks.

Evaporative coolers, even if made smaller, still could not be carried by a user from place to place in view of the need for a household power supply, nor could they be used in places such as picnic areas or amusement parks where no such power is available. The required reservoir also makes portability impractical due to spillage and leakage problems.

Portable misting fans or misters also provide a cooling function. These devices include a reservoir to store water and an atomizer to expel the water in tiny droplets. A fan is typically supplied as well to blow the droplets onto the user's head or face. Evaporation of the atomized water cools the user and the surrounding air. Although portable and personal in function, the primary disadvantage of all misting fans or misters is that excessive amounts of water are dispensed during normal operation. This soaks the users' clothes, causes inconvenience when engaged in activities such as eating, and also dries the skin if used excessively. Such devices produce a cooling effect on the skin rather than cooling air and therefore such devices are not personal air coolers or air conditioners as those terms are defined in this disclosure.

This there is a need for a self-powered air cooling device that does not require a conventional household power supply so that it can be truly portable. There is also a need for an air cooling device that includes no water reservoir so that leakage and spillage problems associated with portable reservoirs are eliminated. The needed device should be very compact and light-in-weight so that it has a personal size scale that is efficiently used by a single user. It should be easy to use, easy to maintain in a clean condition, and should be designed so that it can operate for long periods of time.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved personal air cooling means is now met by a new, useful, and non-obvious invention.

The inventive structure is a compact, portable, hand-held evaporative air cooler or air conditioner with a blower or fan arrangement powered by an electric motor that moves air through an air-permeable water-retaining element such as a sponge or a wick. The fan blows the cooled air to an air outlet that directs cool and humidified air towards a user's face, head, or body as selected by the user.

Best used in hot and dry areas, the hand-held device provides a constant stream of cool air. It may be hand-held, strapped to a hand, or carried in other ways. For example, it may be mounted onto a waist pouch so that it can direct cool air into the shirt of a user. It may be provided with a strap so that it can be worn around the neck. It can be mounted on a backpack, placed on a flat support surface such as a table, clipped to a belt, and so on.

The novel device includes a hollow handle that also serves as a battery compartment. A main housing is formed integrally with the handle and includes a first chamber for receiving a water-retaining element such as a sponge and a second chamber that includes a fan, a small DC motor for rotating the fan, and an air passageway that directs cooled air to an outlet vent. A partition wall separates the two chambers. An aperture formed in the partition wall enables ambient air pulled into the device by the fan to flow through the water-retaining element and to the outlet vent. The first chamber has a depth greater than the depth of the water-retaining element so that an empty space is provided between the water retaining element and the fan. This reduces the load on the motor that drives the fan and thus extends the life of the batteries.

The novel device provides true portability by means of the self-contained power source. It does not contain a reservoir to feed water to the water-retaining element, thereby eliminating the spillage and leakage problems associated with reservoirs.

The primary object of this invention is to provide a personal-scale light-in-weight air conditioning means that is adapted to be carried on the person of an individual user.

Another important object is to provide such a device with features that extend the life of the batteries used as its power source.

Still another object is to provide a reservoir-free air-cooling device.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
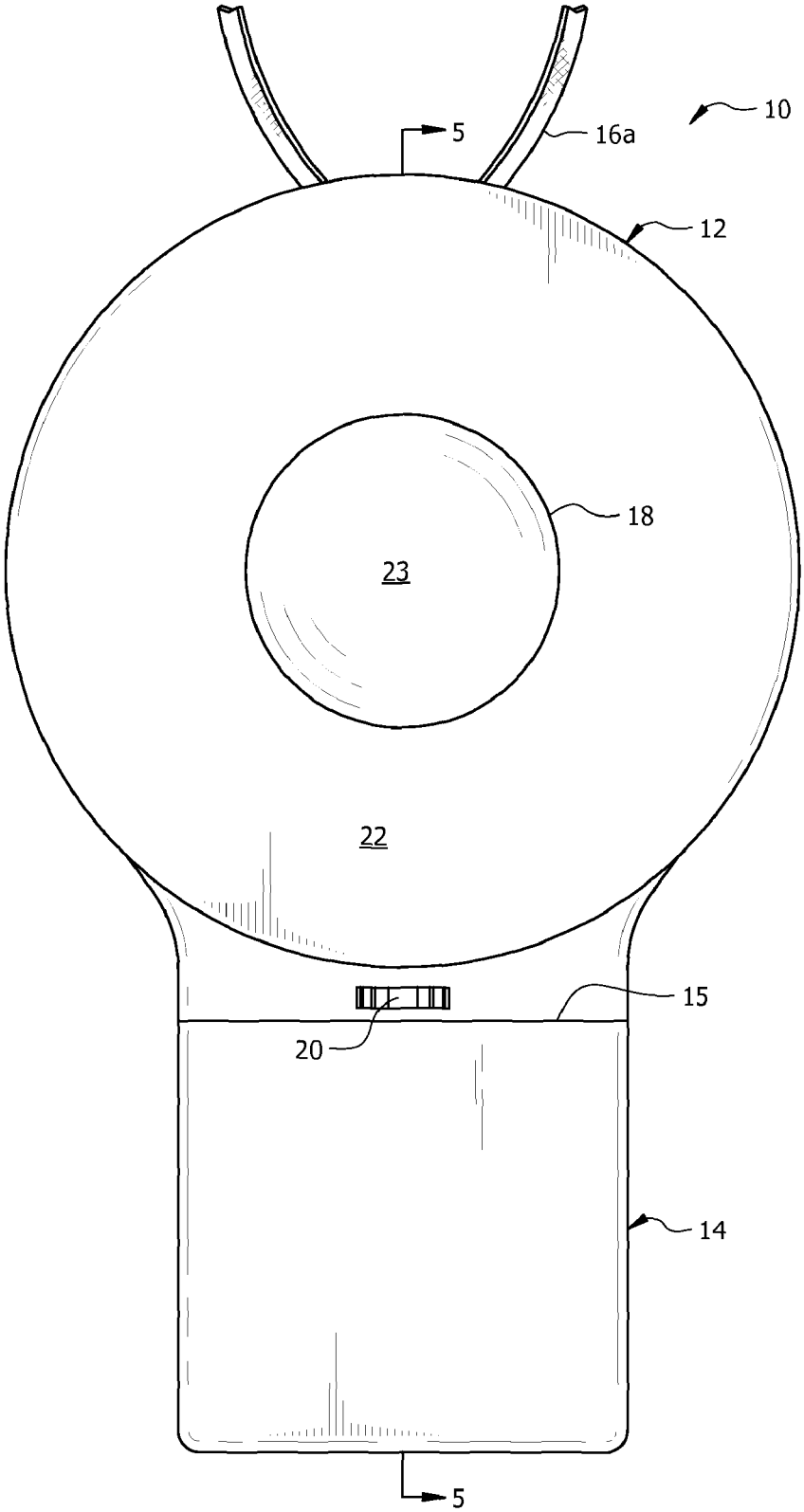
FIG. 1 is a front elevational view of a preferred embodiment.

Referring now to the front elevational view of FIG. 1, it will there be seen that an illustrative embodiment of the invention is denoted as a whole by the reference numeral 10.

Portable air conditioner 10 includes generally circular, disc-shaped main housing 12 and handle 14 that protrudes radially from said main housing. The opposite ends of lanyard 16 engage circumferentially spaced apart eyelets, not depicted in FIG. 1, that are formed integrally with main housing 12. Handle 14 enables one-hand operation of device 10. Hemispherical housing 18 covers the trailing end of a small DC motor, not depicted in FIG. 1, that protrudes from main housing 12. Power switch 20 for activating and de-activating the small DC motor is mounted conveniently on the front of device 10. Spiral duct enclosure 22 forms a part of main housing 12 and is mounted for free rotation about axis of rotation 23 at the center of main housing 12.

Figure 2:
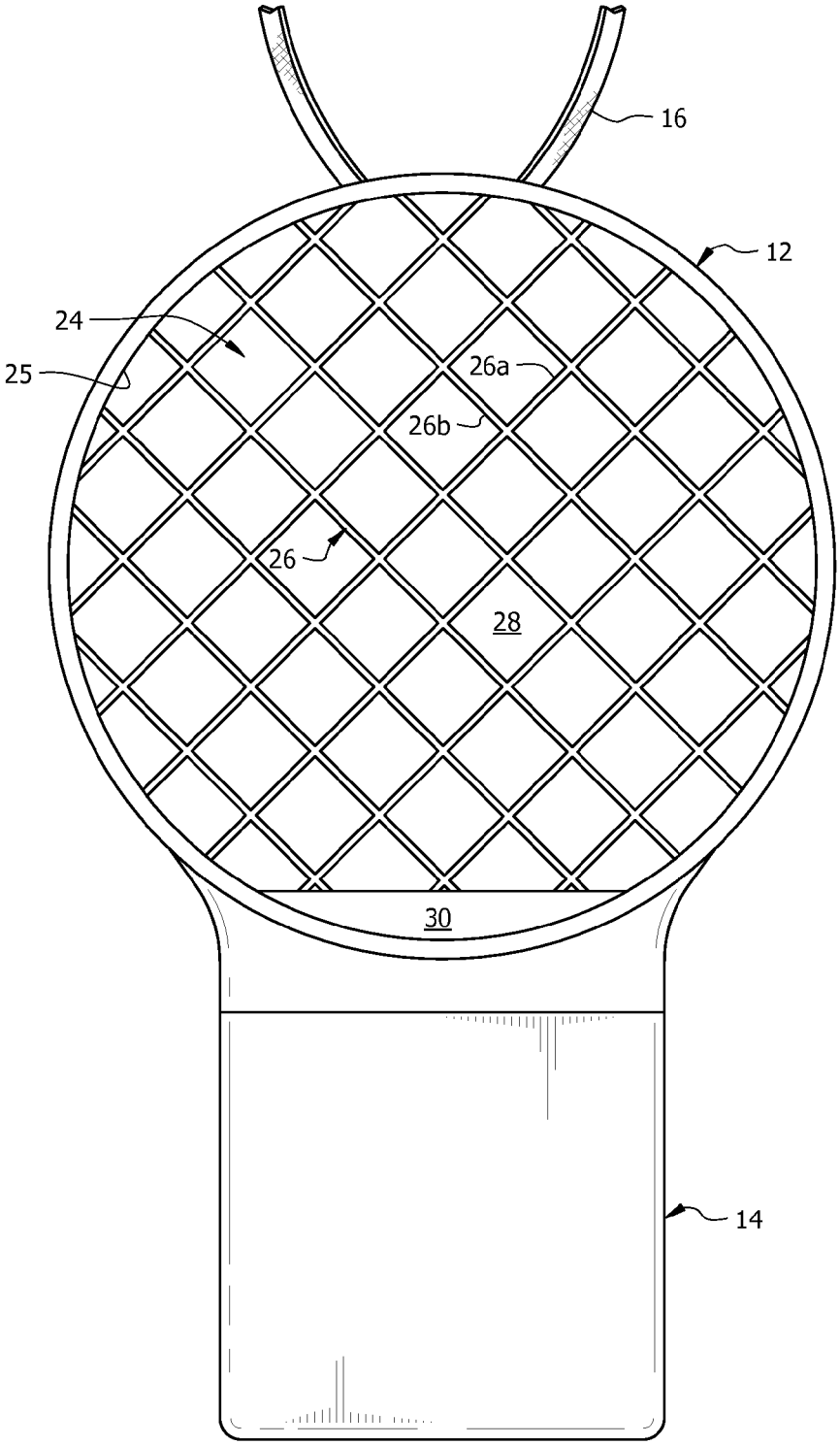
FIG. 2 is a rear elevational view of said preferred embodiment.

Referring now to the rear elevational view of FIG. 2, there it will be seen that a circular or disc-shaped sponge 24 is snugly fit into a first chamber or cavity 25 on the rear side of device 10. Sponge 24 may be provided in many forms; broadly speaking, it is a water or other liquid fluid-retaining, air-permeable element. In the preferred embodiment, the water-retaining, air-permeable element is provided in the form of a cellulose sponge. For convenience, it is referred to simply as sponge 24. Sponge 24 is further retained by a first plurality of straight, parallel retainers 26*a* and a second plurality of straight, parallel retainers 26*b* disposed normal to said first plurality of retainers. These intersecting retainers collectively form outer grill 26. The diamond or square-shaped interstitial spaces between said intersecting retainers define air inlets 28 that admit ambient air onto the exposed surface of sponge 24. In a commercial embodiment, outer grill 26 is provided in a shell-like form with a large plurality of openings formed in it. A fan assembly, not depicted in FIG. 2, pulls ambient air through said interstitial spaces (in the depicted embodiment) or through the large plurality of openings formed in the shell-like cover (in the commercial embodiment) and through sponge 24 when the small DC motor mentioned above is activated. Outer grill 26, in both embodiments, thus prevents sponge 24 from falling out of first chamber 25 while minimizing obstruction to air flow through said sponge 26. As depicted, first chamber 25 extends to a level that is just above the handle. However, in the commercial embodiment, first chamber 25 extends all the way down to the bottom of the handle to maximize the sponge surface area. The larger chamber increases the efficiency of the device.

Outer grill 26 is detachable by means of snap-on or screw-type attachments to provide ready access into first chamber or cavity 25 during removal and replacement of sponge 26 and cleaning procedures. Outer grill 26 can be provided in many shapes and forms, including linear or radial struts, as long as it serves as an air inlet allowing ambient airflow through the sponge with nominal resistance to such airflow.

Water collection basin 30 at the bottom of first chamber 25 performs the function its name expresses, i.e., it collects excess water that may flow from sponge 26 under the influence of gravity. Sponge 26 is wrung to remove excess water prior to its insertion into its cavity but basin 30 is needed for those times where the wringing procedure leaves excess water in the sponge.

Figure 3:
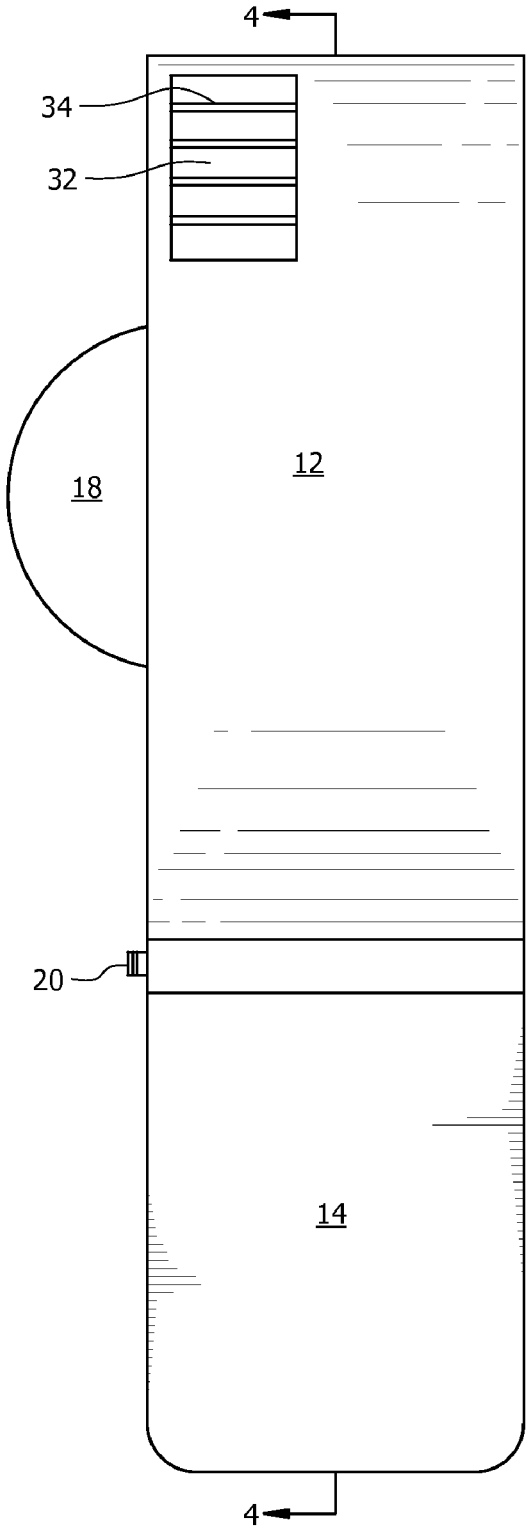
FIG. 3 is a side elevational view thereof.

The side elevational view of FIG. 3 discloses that air that has been cooled by flowing through sponge 26 is discharged from a sidewall of main housing 12 through outlet vent 32 that is divided by a plurality of fixed output air guide baffle walls 34.

Figure 4:
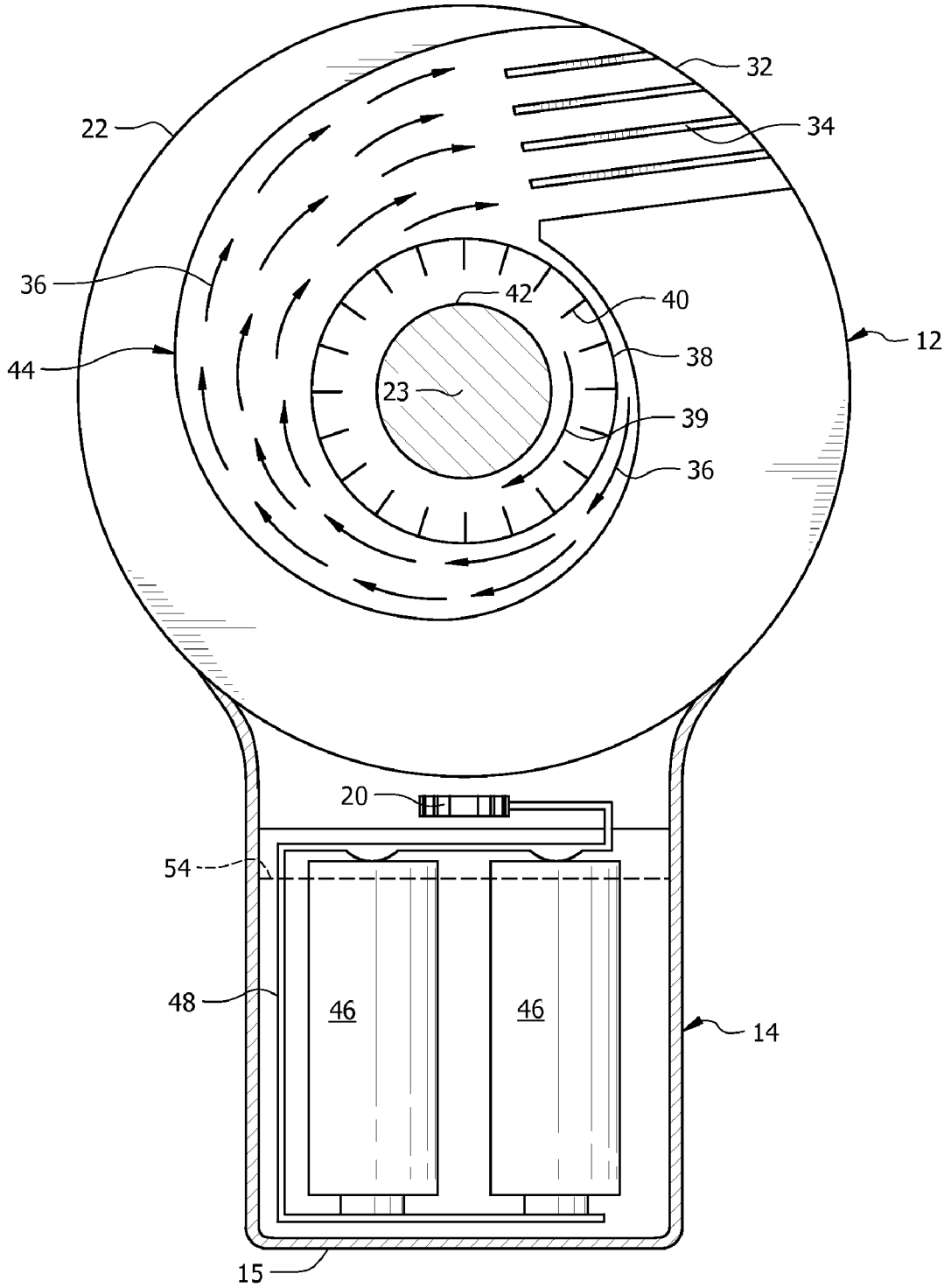
FIG. 4 is a sectional view taken along line 4-4 in FIG. 3.

The structure of outlet vent 32 and baffle walls 34 is best understood in connection with FIG. 4. Spiral airflow, denoted by directional arrows 36, is caused by rotation of fan or propeller 38 in the direction indicated by directional arrow 39. Propeller 38 includes a plurality of radial blades 40 and is driven by small DC motor 42. Spiral duct casing 44 defines the air passageway. As depicted in FIG. 4, it is narrowest at its radially innermost point and it widens gradually as it approaches outlet vent 32.

Spiral duct casing 44 is an air passageway formed in spiral duct enclosure 22, disclosed above in connection with FIG. 1. Spiral duct enclosure 22 forms a part of main housing 12 and is mounted for rotation about axis of rotation 23 relative to said main housing. Spiral duct air passageway 44 has a first, narrow end in fluid communication with a discharge side of fan 38 and a second, wide end in fluid communication with outlet vent 32. Accordingly, manual rotation of spiral duct enclosure 22 about axis 23 effects conjoint rotation of spiral duct casing 44 and thus changes the direction of air flowing out of outlet vent 32. This enables a user to adjust the direction of said airflow as desired.

In an alternate embodiment, not depicted, spiral duct enclosure 22 is not rotatable. However, the direction of air flow through outlet vent 32 is controlled by pivotal mounting of baffle walls 34 so that the position of said baffle walls can be changed to re-direct airflow as desired by a user.

FIG. 4 also depicts batteries 46 that are positioned within the hollow interior of handle 14, together with their associated electrical circuitry 48. Batteries 46 are in electrical communication with small DC motor 42 through power switch 20. Handle 14 has flat bottom 15 so that device 10 may be supported in an upstanding configuration on a table top or other level support surface.

Figure 5:
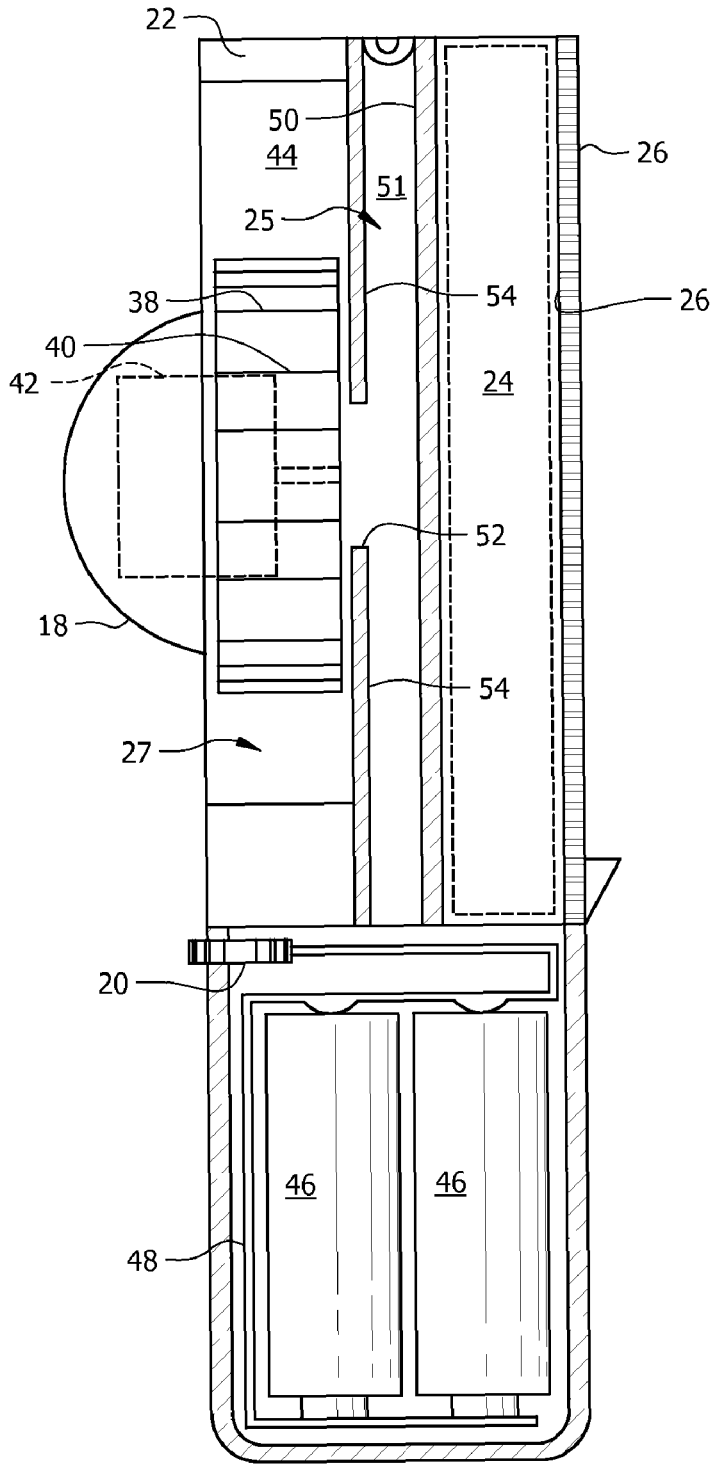
FIG. 5 is a sectional view taken along line 5-5 in FIG. 1.

Referring now to FIG. 5, there it will be seen that sponge 24 is sandwiched between outer grill 26 and inner grill 50 which may have the same structure as outer grill 26 for the same reason, i.e., to retain sponge 24 in place while maximizing airflow through said sponge. In a commercial embodiment, inner grill 50 is supplanted by a plurality of struts that guide the cooled air to the intake ducts.

Central aperture 52 is formed in partition wall 54 that separates first chamber 25 from a second chamber 27 that includes spiral duct enclosure 22 having spiral duct passageway 44 formed therein. As is clear from FIG. 5, sponge 24 does not occupy all of first chamber 25, there being space 51 between inner grill 50 and partition wall 54. Space 51 allows air to flow freely through sponge 24 as desired. Air flowing through sponge 24 enters space 51 and then flows through aperture 52 into the hollow interior of propeller 38 having blades 40 as aforesaid. Aperture 52 may thus be thought of as an intake duct.

A plurality of small throughbores may also be formed in sponge 24 to further enhance the flow of air therethrough, said throughbores reducing resistance to airflow and thus reducing the load on small DC motor 42 and extending the life of batteries 46.

Space 51 maximizes the efficiency of the evaporation process and reduces the load on the fan assembly that includes propeller 38 and small DC motor 42. Space 51 is essential to allow full utilization of the entire surface area of sponge 24. Apart from employing inner grill 50, other methods to create space 51, such as providing a set of pins, ridges, fins, or struts located within first chamber 25 for support of sponge 24, are within the scope of this invention.

Evaporation occurs when relatively drier and hotter ambient air passes through sponge 24; accordingly, the evaporation process results in generation of cooled and humidified air. Air flow from sponge 24 then passes through inner grill 50, to space 51, and into intake duct 52.

Outer grill 26, sponge 24, and inner grill 50, or their equivalent structures, are housed within main housing 12 through which air may flow with minimum loss of suction force. Main housing 12 is not restricted to its depicted cylindrical shape;

it may take the form of an oval cylinder, a rectangular cylinder, or the like as long as the purpose of providing an enclosed airflow casing is served.

Users can remove and replace inner grill 50 for cleaning by detaching outer grill 26 from main housing 12.

As also depicted in FIG. 5, a pair of eyelets 52 are formed on main housing 12 in circumferentially spaced relation to one another to provide connection points for opposite ends of lanyard 16. Only one eyelet can be seen in FIG. 5. Lanyard 16 is worn around the neck and allows device 10 to be positioned on a user's chest, thereby sending cool air towards the users' facial area. Other forms of attaching a lanyard or neck strap to main housing 12 may be used, such as buckles and snaps, Velcro® hook and loop fasteners, and the like.

Propeller 38 may be a centrifugal propeller as depicted or it may take other forms, such as a radial propeller. The linkage between propeller 38 and motor 42 may include whatever gears and shafts are necessary to position DC motor 42 in operable relation to propeller 38.

Hemispherical motor housing 18 is not needed if motor 42 is so small that it does not protrude beyond the plane of the front wall of main housing 12 as depicted in FIG. 5.

As best understood by comparing FIGS. 4 and 5, small DC motor 42 is powered by four (4) 1.5 Volts DC AA-size alkaline batteries 46. Other self-contained power sources within the scope of this invention include lead acid batteries, solar power cells, Ni-Cad batteries, or lithium batteries. Although these batteries add to the weight of the novel device, making it perhaps unsuitable for being worn around a neck for some users, they enable production of a strong, fast-flowing airflow of cooled air and the device is still sufficiently light-in-weight to enable it to be hand-carried or strapped to a user's hand or to a user's belt or other item of clothing or equipment.

Power switch 20 can be provided in many different forms, such as a toggle switch, electronic push button, heat-sensitive button, slide switch, and so on. Device 10 may also incorporate a set of LED lights, not depicted, to show the status of operation.

The exterior of handle 14 is removable and is covered with synthetic rubber for improved gripping when held in the users' hands. Handle 14 may also be non-removable, in which case a spring loaded battery cover may provide an alternative means of access to the battery compartment. Water-proof rubber sealing 54, depicted in FIG. 4, is installed around the opening edges of removable handle 14 for water protection.

Figure 6:
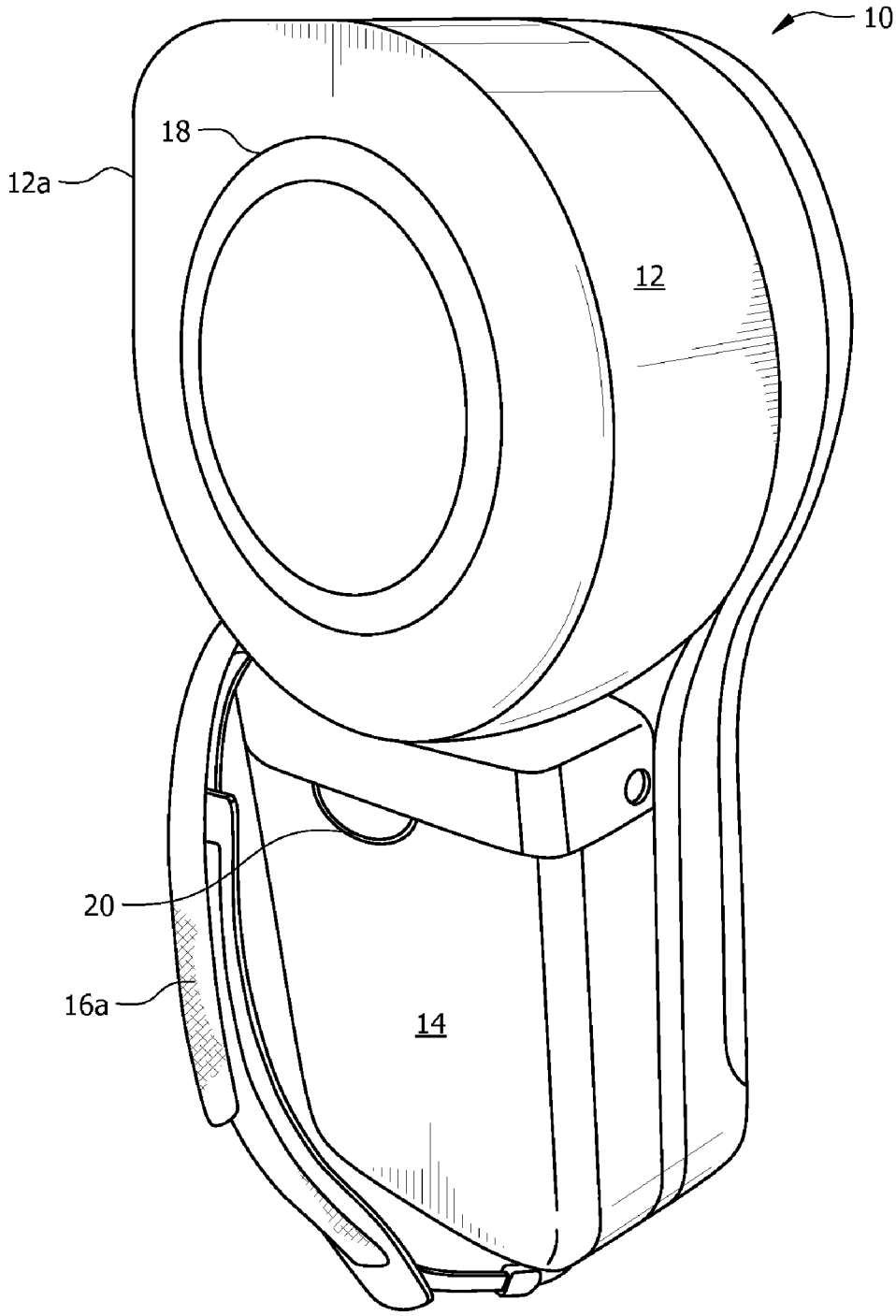
FIG. 6 is a perspective view of a preferred embodiment.

FIG. 6 is a perspective view of a commercial embodiment of the invention. Hand strap 16*a* enables the device to be strapped to a user's hand, a belt, or other item of equipment or clothing. Housing 12 in this embodiment includes a flat part 12*a* where outlet vent 32 is positioned.

To use device 10, a user soaks sponge 24 under cold tap water and squeezes out excess water until no dripping is observed. Users may apply aromatherapy solutions or air purification solutions as desired onto the sponge. Sponge 24 is then placed into sponge chamber 25 and outer grill 26 is re-attached to main housing 12.

When power switch 20 is turned ON, ambient air is drawn in through inlets 28 by action of propeller 38 and is cooled as it flows through wet sponge 24. The cooled air is then forced out of main housing 12 through outlet vent 32. Device 10 provides up to ten degree Celsius (10° C.) temperature drop in a thirty degree Celsius (30° C.), ten percent (10%) relative humidity environment. One (1) fully soaked sponge provides cooling for up to 5 (five) hours depending on the ambient surrounding.

This invention provides effective cool air as long as sponge 24 remains moist, and as long as the fan assembly creates a positive airflow through said sponge to said outlet vent 32. The device can be used anywhere when held in one hand, or placed on a flat surface, or onto a mounting apparatus such as a waist pouch or a neck strap. Users can enjoy the luxury of cooled air without the need for their body to engage in direct contact with water, as required by conventional portable misters. Places with higher temperature and lower relative humidity, such as in the desert will increase the performance and efficiency of this novel device. Using cold water will also enhance performance.

Sponge 24 may be pre-treated with anti-bacterial or anti-mold solution to inhibit growth of germs on the sponge. Aromatherapy fragrance or essential oils can be applied to the sponge by using dripper or spray bottles filled with such oils, so that the scents and essence are delivered to the user by the air passing through the sponge. The novel device can also be used as a personal air purifier by saturating anti-bacterial/anti-viral solutions into the sponge immediately prior to usage. In this case, ambient airflow passing through the solution-saturated sponge is purified.

A cavity or basin where ice can be placed may be incorporated into the device, such as ice cubes placed in space 51. Cooling efficiency is thereby enhanced by sponge 24 absorbing melted water from the ice and airflow passing in close communication with said ice cubes before the airflow exits the device. This enhancement is not depicted in the drawings.

One or more sponges which are formed of an air-permeable water-retaining material may be used. The sponge material must be water or liquid retaining or absorbing in nature, allowing airflow to freely pass therethrough and retaining the water without undue expulsion once saturated. Materials such as HDPE, PVA compound sponges, paper or cardboard wicks or filters, or even fabric material may be used. The air-permeable water-retaining element is also adapted to hold liquid fluid other than water. Moreover, the air-permeable water-retaining element is preferably formed of a material capable of being saturated.

The by-product of the evaporation process provides humidified and moist output air. The purpose of the novel air cooler extends to a portable hand-held humidifier as well. Such device is also considered to be a compact portable hand-held humidifier. The device takes advantage of both of the effects of evaporation which is firstly a temperature drop and secondly an increase in relative humidity under certain ambient conditions.

The device can be provided with a conventional clip so that it can be clipped to a belt or other item of clothing. It may also be inserted into a holster that is clipped onto a belt. Hand strap 16*a* may employ Velcro® hook and loop fasteners as depicted in FIG. 6, or any other well-known means such as straps used in watch bands, for example.

This invention is not limited to a fan assembly that includes the preferred small DC motor. The fan assembly could also be powered by an external source such as a household power supply or USB power through the use of an adaptor cord. Nor is the invention limited to a single speed fan. The fan assembly may be controlled by a variable speed controller such as a variable resistor, for example.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A personal air cooling apparatus, comprising:

a main housing having a hollow interior;

at least one air inlet that permits ambient air to flow into said main housing;

a water-retaining air permeable element disposed within said main housing;

an air-moving means mounted in said main housing for moving ambient air through said water-retaining air permeable element;

at least one air outlet vent formed in said main housing through which air that has traveled through said water-retaining air permeable element is directed into an ambient environment;

said personal air cooling apparatus being light-in-weight so that it can be carried by a user;

said main housing including an outer grill detachably secured thereto, said outer grill forming a rear side of said main housing;

said main housing including an inner grill detachably secured thereto in parallel relation to said outer grill, said inner grill being mounted in said hollow interior of said main housing; and said water-retaining air permeable element being disposed in sandwiched relation between said outer grill and said inner grill.

2. The apparatus of claim 1, further comprising:

said main housing including a first chamber for receiving said water-retaining air permeable element;

said main housing having a second chamber for receiving said air-moving means;

a partition wall mounted within said main housing for separating said first chamber from said second chamber;

an aperture formed in said partition wall so that ambient air follows a path of travel through said water-retaining air permeable element, through said aperture, through said air-moving means, and through said at least one air outlet.

3. The apparatus of claim 2, further comprising:

said first chamber having a predetermined depth greater than a predetermined depth of said water-retaining air-permeable element;

an empty space between said partition wall and said water-retaining air-permeable element, said empty space having a depth determined by the difference in depth between the predetermined depth of said first chamber and the predetermined depth of said water-retaining air-permeable element;

said empty space facilitating flow of ambient air through said water-retaining air-permeable element and thereby reducing the load on said air-moving means.

4. The apparatus of claim 2, further comprising:

said air-moving means including an electric fan assembly disposed within said second chamber.

5. The apparatus of claim 4, further comprising:

said electric fan assembly including a small DC motor having an output shaft and a propeller mounted to said shaft for conjoint rotation therewith.

6. The apparatus of claim 5, further comprising:

at least one battery for providing power to said small DC motor.

7. The apparatus of claim 6, further comprising:

said at least one battery including four (4) AA DC batteries so that said fan assembly produces a strong, fast-flowing airflow of cooled air.

8. The apparatus of claim 1, further comprising:

said apparatus having a size, shape, and weight that enables it to be carried in a hand of a user.

9. The apparatus of claim 8, further comprising:

securing means for removably securing said main housing onto a hand of a user.

10. The apparatus of claim 9, further comprising:

said securing means including a handle formed integrally with said main housing so that the device may be gripped by said handle.

11. The apparatus of claim 10, further comprising:

said handle being hollow and said at least one battery being positioned within a hollow interior of said handle.

12. The apparatus of claim 9, further comprising:

said securing means including a hand strap adapted to secure said device to a user's hand.

13. The apparatus of claim 1, further comprising:

said air-permeable water-retaining element being adapted to hold liquid fluid other than water.

14. The apparatus of claim 1, further comprising:

said air-permeable water-retaining element being formed of a material capable of being saturated.

15. The apparatus of claim 1, further comprising:

said air-permeable water-retaining element being formed of a material selected from a group of materials including cellulous sponge and porous, foam-like liquid-absorbing material.

16. The apparatus of claim 1, further comprising:

said air-permeable water-retaining element having small throughbores formed therein to enhance airflow through said air-permeable water-retaining element and to reduce the load on said air-moving means.

17. The apparatus of claim 1, further comprising:

said air-permeable water-retaining element adapted to hold aromatherapy oil to provide an aromatic scent to the airflow.

18. The apparatus of claim 1, further comprising:

said air-permeable water-retaining element adapted to hold anti-bacterial or anti-viral liquid fluids.

19. The apparatus of claim 1, further comprising:

a spiral duct enclosure;

said spiral duct enclosure forming a part of said main housing and being mounted for rotation relative to said main housing;

a spiral duct air passageway formed in said spiral duct enclosure;

said spiral duct air passageway having a first, narrow end in fluid communication with a discharge side of said fan and a second, wide end in fluid communication with said outlet vent;

whereby rotation of said spiral duct enclosure effects simultaneous and corresponding rotation of said spiral duct air passage and hence rotation of said outlet vent so that a path of travel of cooled air flowing out of said outlet vent is adjustable.

20. The apparatus of claim 1, further comprising:

a plurality of baffle walls disposed in said air outlet vent;

said baffle walls being pivotally mounted;

said baffle walls being movable by a user so that a path of travel of cooled air flowing through said air outlet vent is affected by the position of said baffle walls so that the user may direct such airflow.

* * * * *